US007165543B2

(12) United States Patent
Simo et al.

(10) Patent No.: US 7,165,543 B2
(45) Date of Patent: Jan. 23, 2007

(54) ELECTRICALLY ACTIVATED ARROW REST

(75) Inventors: Miroslav A. Simo, Riverside, IL (US); Robert S. Mizek, Downers Grove, IL (US); Frank A. Harwath, Naperville, IL (US); Christopher A. Kozlik, Schaumburg, IL (US)

(73) Assignee: New Archery Products Corp., Forest Park, IL (US)

( * ) Notice: Subject to any disclaimer, the term of this patent is extended or adjusted under 35 U.S.C. 154(b) by 191 days.

(21) Appl. No.: 10/889,968

(22) Filed: Jul. 13, 2004

(65) Prior Publication Data

US 2006/0011182 A1 Jan. 19, 2006

(51) Int. Cl.
*F41B 5/22* (2006.01)

(52) U.S. Cl. ..... 124/44.5; 124/24.1; 124/32

(58) Field of Classification Search ..... 124/41.1, 124/44.5, 88, 35.2, 32, 31, 24.1
See application file for complete search history.

(56) References Cited

U.S. PATENT DOCUMENTS

| | | | | |
|---|---|---|---|---|
| 3,871,352 | A | 3/1975 | Stanislawski et al. | |
| 4,179,613 | A * | 12/1979 | Koren | 250/215 |
| 4,343,286 | A | 8/1982 | Thacker | |
| 4,572,153 | A | 2/1986 | MacPherson | |
| 4,865,007 | A | 9/1989 | Saunders | |
| 5,205,268 | A | 4/1993 | Savage | |
| 5,243,957 | A * | 9/1993 | Neilson | 124/88 |
| 5,415,154 | A | 5/1995 | Angeloni | |
| 5,503,136 | A | 4/1996 | Tone | |
| 5,606,961 | A | 3/1997 | Basik et al. | |
| 6,029,120 | A * | 2/2000 | Dilger | 702/142 |
| 6,044,832 | A | 4/2000 | Piersons, Jr. | |
| 6,178,959 | B1 | 1/2001 | Troncoso, Jr. et al. | |
| 6,191,574 | B1 * | 2/2001 | Dilger | 324/178 |
| 6,526,666 | B1 * | 3/2003 | Lastinger, Jr. | 33/265 |
| 6,561,174 | B1 | 5/2003 | Afshari | |
| 6,688,297 | B1 * | 2/2004 | Clague | 124/44.5 |
| 6,823,856 | B1 * | 11/2004 | Rager | 124/44.5 |
| 6,938,615 | B1 * | 9/2005 | Walker et al. | 124/44.5 |
| 2002/0003726 | A1 * | 1/2002 | Hattori et al. | 365/200 |
| 2003/0024516 | A1 | 2/2003 | Mizek et al. | |
| 2003/0127083 | A1 | 7/2003 | Musacchia, Jr. | |

* cited by examiner

*Primary Examiner*—Michael J. Carone
*Assistant Examiner*—James S. Bergin
(74) *Attorney, Agent, or Firm*—Pauley Petersen & Erickson

(57) ABSTRACT

An arrow rest mountable to an archery bow for supporting an archery arrow with respect to the archery bow. The arrow rest includes a sensor that senses a first movement of the archery arrow with respect to the archery bow and/or a second movement of the archery bow, and transmits a signal upon sensing the first movement and/or the second movement. A signal processor in communication with the sensor receives the signal and moves the arrow rest in response to the received signal.

21 Claims, 8 Drawing Sheets

ELECTRICALLY ACTIVATED ARROW REST

BACKGROUND OF THE INVENTION

1. Field of Invention

This invention relates generally to an arrow rest mountable to an archery bow for supporting an archery arrow with respect to the archery bow and, more particularly, to an electrically activated arrow rest.

2. Discussion of Related Art

Archery bows require an arrow rest to support and hold an archery arrow in a proper drawn or holding position. It is desirable to position the arrow properly on the arrow rest to launch the arrow without contact or interference with the arrow rest, in order to maintain the flight path of the arrow.

Archery arrows are made with fletching including vanes molded of plastic or polymeric materials, which are more accurate than feathers and are weather-resistant. However, such plastic or polymeric vanes cause problems. Unlike feathers that are flexible, the plastic vanes, when contacting an arrow rest during launching of the arrow, further deflect the arrow during launch in an unpredictable manner. In order to solve accuracy problems associated with the use of plastic vanes, one known arrow rest, sometimes referred to as a "shoot through" arrow rest, supports the arrow with a pair of prongs or thin blades, providing a slot through which one of the fletching vanes can pass to eliminate or minimize contact between the fletching vane and the arrow rest. Unfortunately, the vane often contacts the arrow rest, resulting in damage to the fletching vane and/or a reduction in launching accuracy.

Another known arrow rest, sometimes referred to as a "fall away" arrow rest, supports the arrow with prongs or another supporting structure. When launching the arrow, the supporting structure withdraws before the fletching vanes can contact the arrow rest. However, when the launched arrow begins to move with respect to the arrow rest, inertia causes the support structure to move relatively slowly. During this time, the arrow should be supported by the arrow rest. As the arrow accelerates, the arrow rest should move out of the arrow flight path to prevent contact between the fletching and the arrow rest. Therefore, the arrow rest must be activated so that the support structure moves within a narrow time frame, typically only a few milliseconds. Current fall away arrow rests include strings, cables and/or linkages to accomplish this movement, each of which results in an undesirable increased complexity. Further, the current fall away arrow rests are difficult to attach to the archery bow and do not work with every type of archery bow.

It is apparent that there is a need for a simple and reliable arrow rest that can be used with a variety of archery bows.

SUMMARY OF THE INVENTION

One object of this invention is to provide an electrically activated arrow rest.

Another object of this invention is to overcome one or more of the problems described above.

The above and other objects of this invention can be attained with an arrow rest that is mountable to an archery bow for supporting an archery arrow with respect to the archery bow. The arrow rest includes a sensor mountable with respect to the archery bow and sensing at least one of a first movement of the archery arrow with respect to the archery bow and a second movement of the archery bow. For example, at least one sensor can be mounted with respect to a shaft of the archery arrow, a limb of the archery bow, a limb pocket, a riser, a cable, a cable slide, a cable guard, a cam, a pulley, a bow string and/or a release aid. The sensor transmits a signal upon sensing at least one of the first movement and the second movement to a signal processor in communication with the sensor. The signal can be transmitted using any suitable transmission mechanism, such as a light source, an optical source, a magnetic field, a vibration, a radio wave, a hydraulic mechanism, a pneumatic mechanism, a direct connection and/or a wire. The signal processor receives the signal and moves the arrow rest in response to the received signal.

In one preferred embodiment of this invention, the arrow rest includes a release element operatively connected to the signal processor to move the arrow rest between an arrow support position and an arrow release position in response to the signal. The release element can include any suitable release mechanism, such as an electric motor, a linear actuator, a hydraulic piston, a pneumatic piston, a solenoid, a spring, a battery, a capacitor, an inductor, a fuel cell, a hydraulic accumulator, a supply of a compressed gas, at least one reactable chemical component and/or at least one combustible material.

In one preferred embodiment of this invention, the arrow rest can include an electronic module housing or containing an optical sensor mountable with respect to a body of the archery bow. The optical sensor has an emitter for emitting a light signal at a shaft of the archery arrow positioned on the arrow rest. Preferably, the emitter includes a light-emitting diode that emits a light signal against a reference mark made of a reflective material and positioned on or attached to the archery arrow shaft. With the archery arrow at a holding position, the light signal is reflected off the reference mark and a receiver senses the reference mark. In response to the optical sensor sensing the reference mark, a transducer transmits a position signal to a signal processor in electrical communication with the optical sensor. The signal processor receives the position signal transmitted by the transducer and generates an output signal in response to the position signal. The output signal can include a stop signal or an actuating signal depending upon a direction of movement of the shaft with respect to the arrow rest and a speed of the movement of the shaft. For example, with the arrow moving in a release direction at a threshold speed, a release element in responsive communication with the output signal is actuatable to move support prongs of the arrow rest between an arrow support position and an arrow release position.

The arrow rest also preferably includes a timer or clock for measuring or calculating a speed of the movement of the archery arrow with respect to the arrow rest, in the release direction. With the archery arrow moving in the release direction at a threshold speed, the output signal includes an actuating signal to activate the release element and move the support prongs from the arrow support position to the arrow release position. Alternatively, with the archery arrow moving in the release direction at a speed less than a threshold speed, the output signal includes a stop signal to prevent movement of the support prongs from the arrow support position to the arrow release position. Further, with the archery arrow moving in the draw direction, the output signal includes a stop signal to prevent movement of the support prongs from the arrow support position to the arrow release position.

In one preferred embodiment of this invention, an arrow rest is electrically activated by emitting a light signal at a shaft of an archery arrow positioned within the arrow rest. An optical sensor senses the reference mark on the shaft with the archery arrow positioned within the arrow rest at a holding position. A movement of the shaft with respect to the arrow rest is detected and a direction of the movement in one of a draw direction and a release direction which is opposite the draw direction is determined. With the movement of the shaft in the release direction, a speed of the movement in the release direction is determined. Based upon the speed of the movement in the release direction, either a stop signal or an actuating signal is transmitted to a release element. With the arrow shaft moving in the release direction and at least at a threshold speed, the release element is actuated to move the support prongs of the arrow rest from an arrow support position to an arrow release position. With the arrow shaft moving in the release direction at less than the threshold speed or with the arrow shaft moving in the draw direction, a stop signal is transmitted to the release element to prevent actuation of the release element to move the support prongs from the arrow support position to the arrow release position.

Other objects and advantages of this invention are apparent to those skilled in the art, in view of the following detailed description taken in conjunction with the appended claims and drawings.

DETAILED DESCRIPTION OF THE INVENTION

Figure 1:
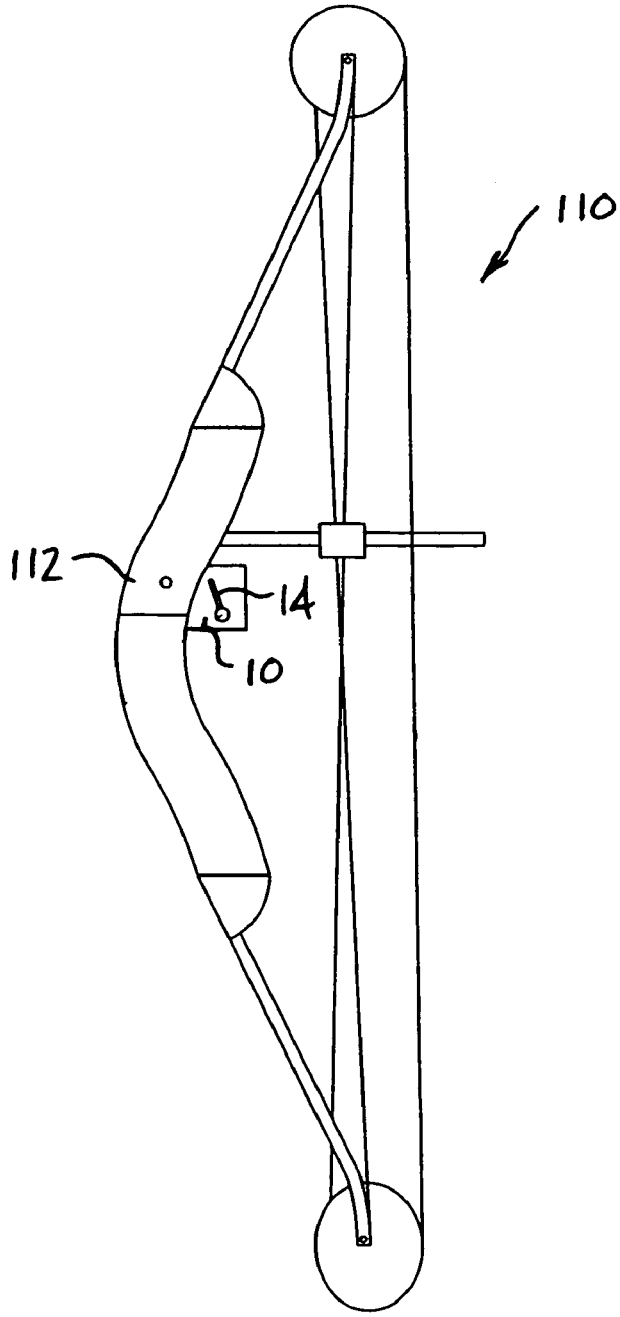
FIG. 1 is a side view of an electrically activated arrow rest mounted to an archery bow, according to one preferred embodiment of this invention.
Figure 2:
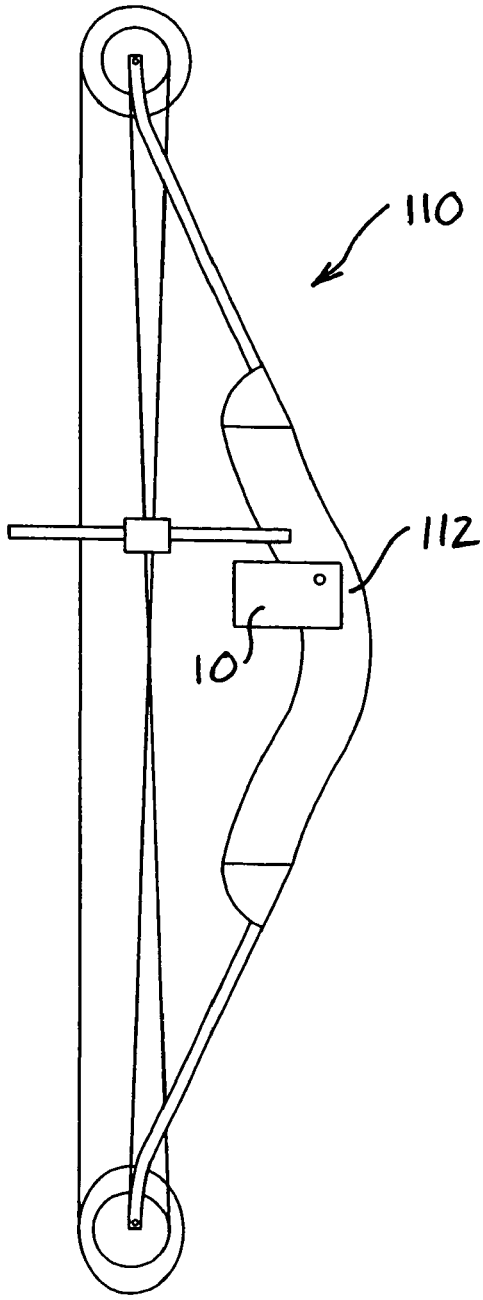
FIG. 2 is an opposite side view of the electrically activated arrow rest shown in FIG. 1, mounted to the archery bow, according to one preferred embodiment of this invention.
Figure 3:
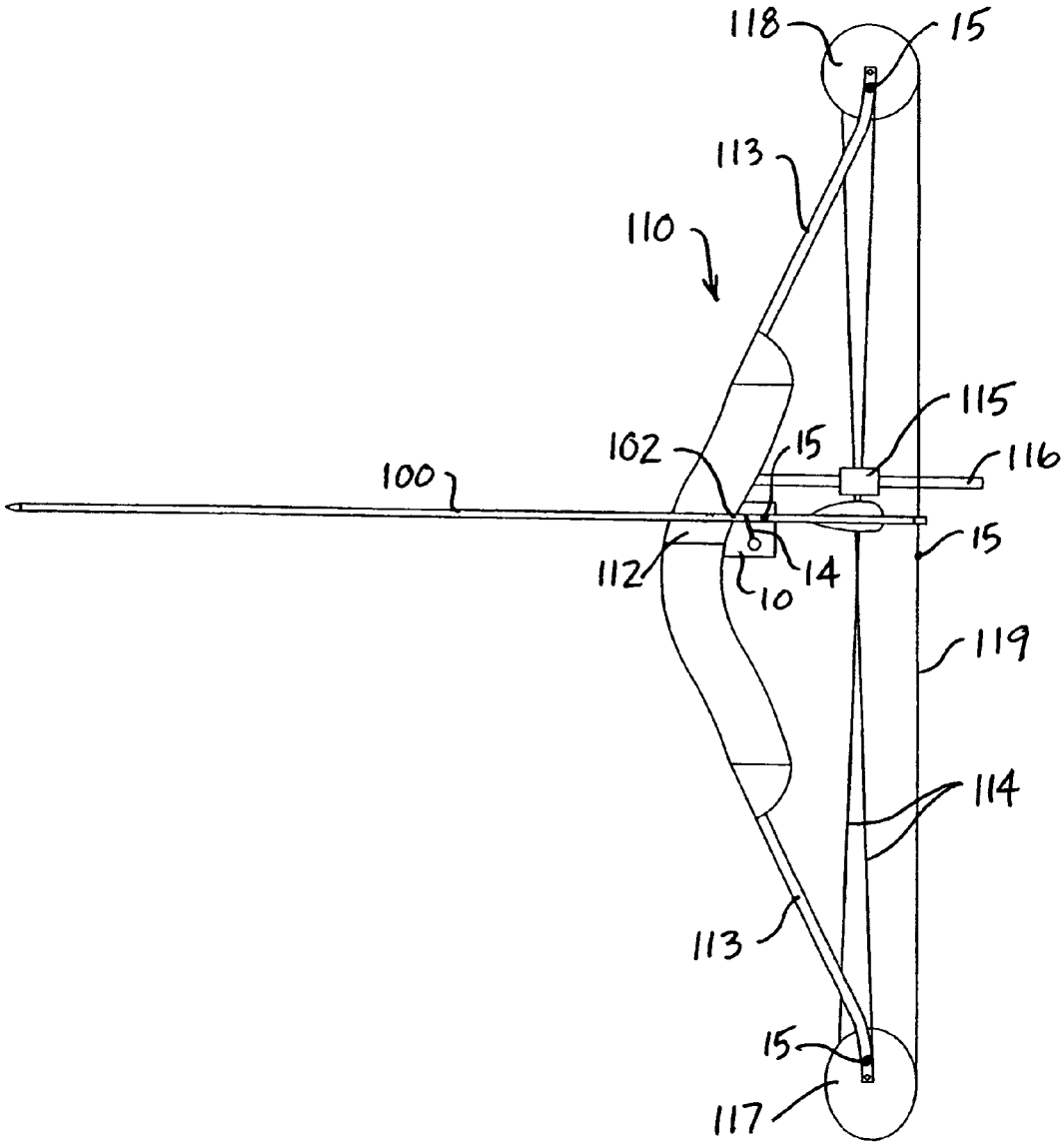
FIG. 3 is a side view of an electrically activated arrow rest mounted to an archery bow and supporting an archery arrow, according to one preferred embodiment of this invention.
Figure 4:
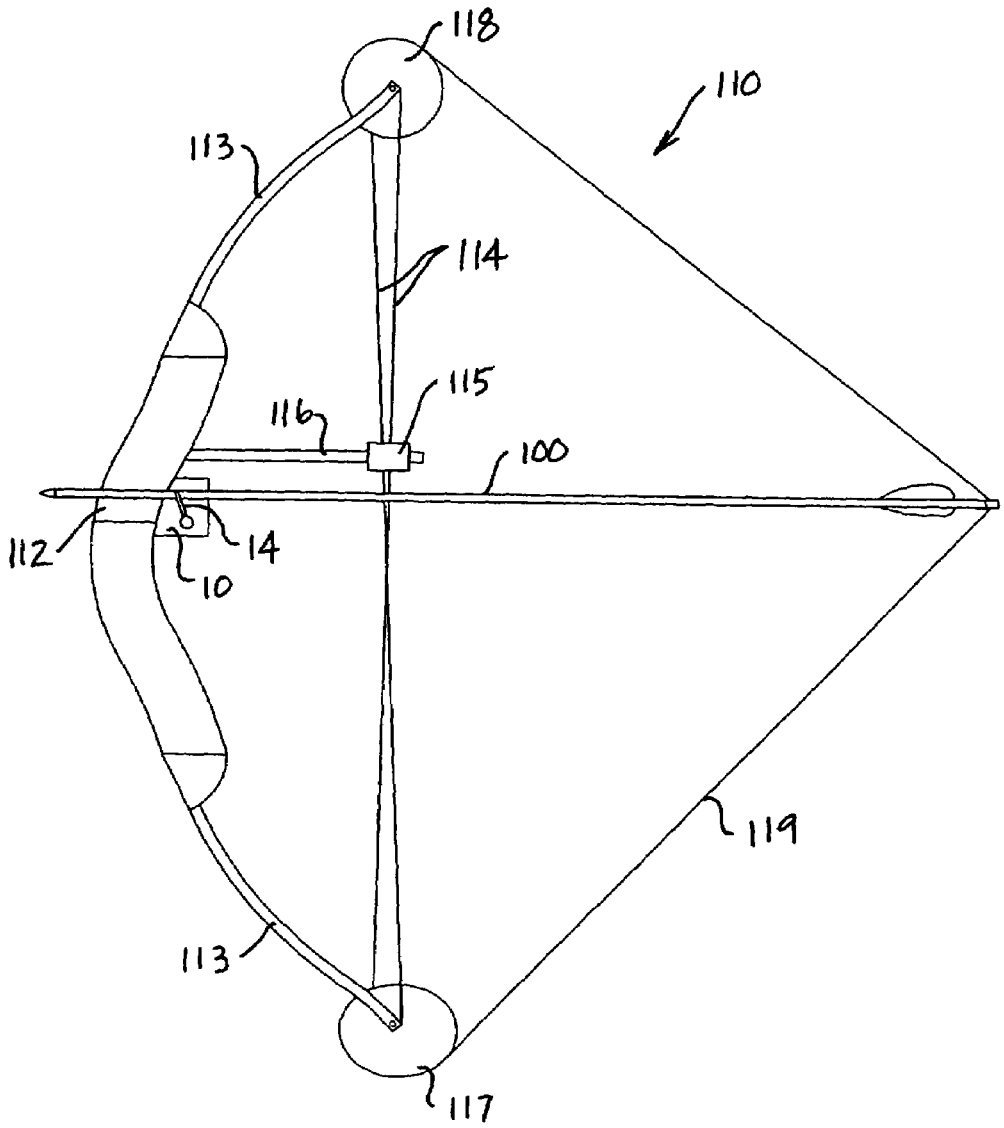
FIG. 4 is a side view of an electrically activated arrow rest mounted to an archery bow and supporting an archery arrow at a drawn position, according to one preferred embodiment of this invention.
Figure 5:
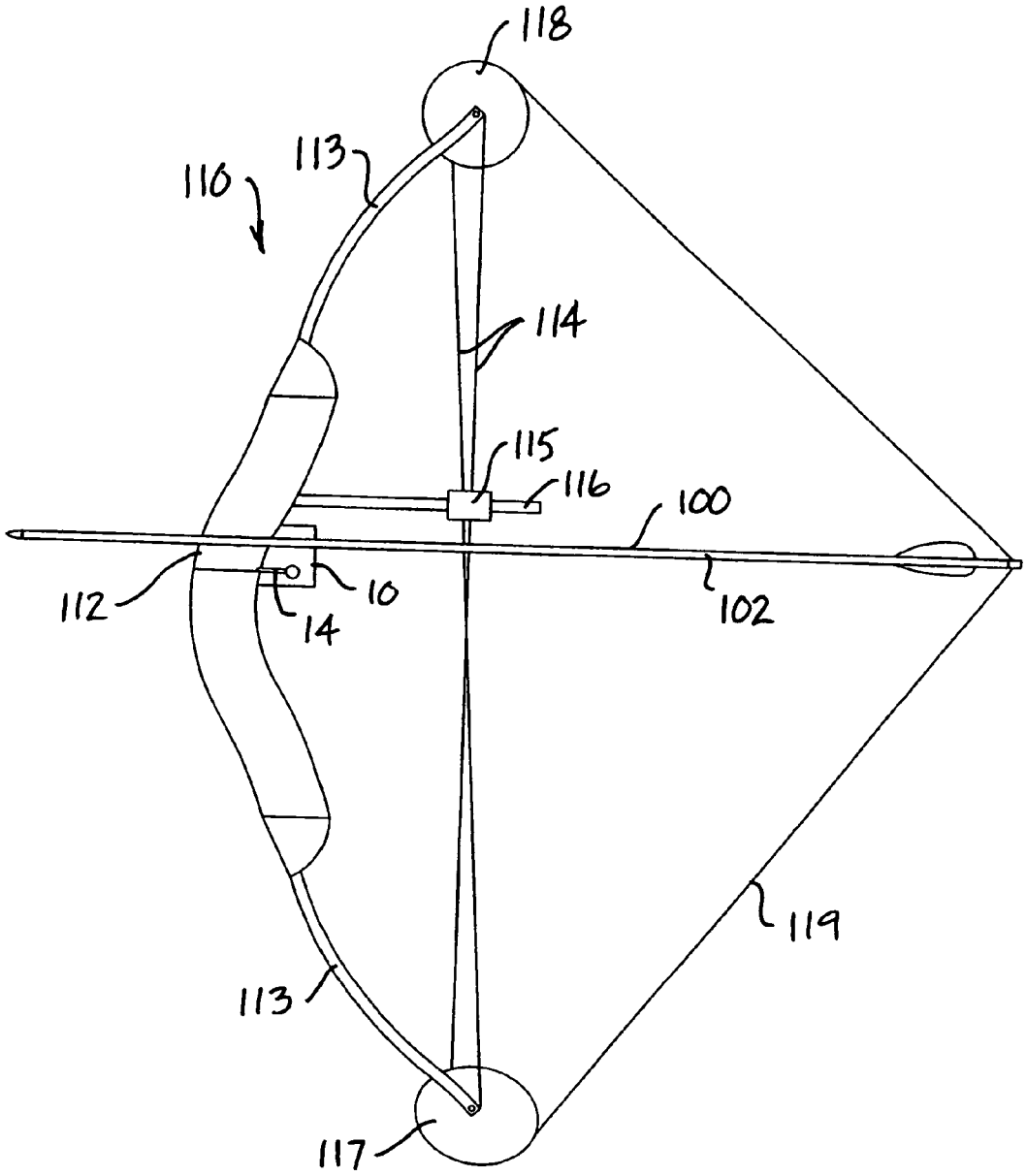
FIG. 5 is a side view of an electrically activated arrow rest mounted to an archery bow in an arrow release position, according to one preferred embodiment of this invention.
Figure 6:
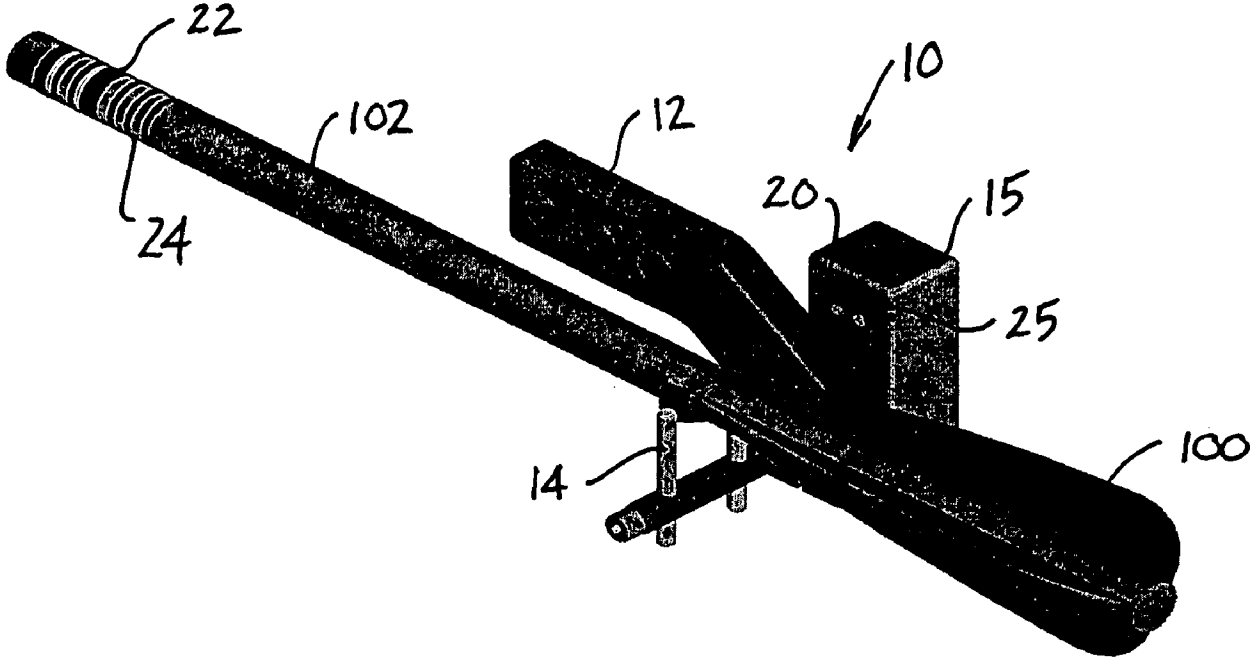
FIG. 6 is a perspective side view of an electrically activated arrow rest, according to one preferred embodiment of this invention.

Referring to FIGS. 1–8, this invention provides an arrow rest 10 that is mountable to an archery bow 110 for supporting an archery arrow 100 with respect to the archery bow 110. For example, as shown in FIG. 4, arrow rest 10 includes a bracket 12 for mounting or connecting arrow rest 10 to archery bow 110. Arrow rest 10 can be mounted or connected to any portion of the archery bow, such as at a riser portion 112 of the archery bow. Further, arrow rest 10 can be mounted or connected above, below, behind or in front of the riser portion. With arrow rest 10 at an arrow support position, as shown in FIGS. 3, 4 and 6, archery arrow 100 can be positioned on and supported by support prongs 14 of arrow rest 10. Preferably, arrow rest 10 includes two cooperating support prongs 14. However, it should be apparent to those skilled in the art and guided by the teachings herein that arrow rest 10 can include one or more support prongs 14.

In one preferred embodiment of this invention, arrow rest 10 can be activated in response to or upon detection of a motion or movement of any part, component or member of the archery bow using any suitable sensor, component or element. For example, a motion or movement of an archery bow component, such as a bow string, a portion of the archery bow body, a release aid and/or a trigger device initially positioned about the bow string, preferably in concert with a motion or movement of the archery arrow shaft 102 with respect to arrow rest 10 and/or the archery bow, can be detected or sensed to activate arrow rest 10 to move between the arrow support position and an arrow release position.

In one preferred embodiment of this invention, arrow rest 10 includes at least one suitable sensor 15, such as a suitable optical or electrical sensor, that senses or detects a first movement of the archery arrow with respect to the archery bow and/or a second movement of the archery bow, such as an arrow release movement. Sensor 15 is mountable with respect to a body of archery bow 110. For example, referring to FIG. 3, sensor 15 can be positioned, located or mounted on, about or within archery arrow shaft 102, riser portion 112, a limb 113 of the archery bow, a limb pocket, a cable 114, a cable slide 115, a cable guard 116, a cam 117, a pulley 118, a bow string 119 and/or a release aid (not shown).

At the instant an archer releases a hold on the bow string, a force is applied to a nock portion of the archery arrow to accelerate the archery arrow in the release direction. Simultaneously, the archery bow limbs accelerate forward, releasing stored energy to provide the force required to accelerate the archery arrow. Thus, the initial movement during launch of the archery arrow is essentially the simultaneous movement of the archery arrow, the bow string and the archery bow limbs. As the archery arrow continues to move, the archery bow cams, cables and cable slide move. Finally, the reaction force of the arrow launch is sufficient to move the heaviest portion of the archery bow in a direction toward the archer's hand. Therefore, in accordance with preferred embodiments of this invention, the movement of the archery arrow and/or the movement of a component of the archery bow that moves in sequence with the archery arrow can be sensed and the arrow rest can be activated to remove the support prongs 14. Sensing the movement of the archery arrow and/or the movement of a component of the archery bow that moves in sequence with the archery arrow provides increased time for moving support prongs 14 away from the archery arrow flight path.

Suitable sensors include but are not limited to phototransistors, photodiodes and suitable light sensing electrical components capable of receiving a direct beam of light and/or a reflected beam of light; magnetic sensors, including coils and magnetically permeable materials; metallic and piezoresistive strain gages; dynamic, capacitive and piezoelectric accelerometers; dynamic, electret and condenser microphones; proximity sensors; and micro-switches.

In one preferred embodiment of this invention, with the archery arrow positioned with respect to arrow rest 10, sensor 15 detects or senses a first movement of the archery arrow with respect to arrow rest 10 and/or the archery bow, and/or a second movement of the archery bow. For example, sensor 15 may sense an arrow release movement of bow string 119 and/or an arrow release movement of limb 113 in concert with a movement of archery arrow shaft 102 with respect to archery bow 110. Preferably, sensor 15 senses the bow string movement and/or the limb movement upon release of the bow string from the holding position to launch the archery arrow. The bow string may be initially held in the holding position using an archer's finger, a release aid and/or a trigger device, for example. Sensor 15 transmits a signal to an activating circuit in communication with sensor 15 upon sensing the first movement and/or the second movement, such the arrow release movement of the bow string. In one preferred embodiment of this invention, the activating circuit includes a signal processor 40 discussed in further detail below. The signal may be transmitted to signal processor 40 using any suitable transmission means or mechanism, such as a light source, an optical source, a magnetic field, a vibration, a radio wave, a hydraulic mechanism, a pneumatic mechanism, a direct connection and/or a wire, for example. It is apparent to those skilled in the art and guided by the teachings herein that other suitable transmission mechanisms can be used with the arrow rest of the present invention.

Signal processor 40 receives and processes the signal to generate a corresponding output signal to move arrow rest 10 in response to the received signal. In one preferred embodiment of this invention, arrow rest 10 includes a release element 45 operatively connected to and/or in responsive communication with signal processor 40 to move arrow rest 10 between the arrow support position and the arrow release position in response to the signal. Release element 45 is operatively connected to support prongs 14 and is actuatable to release support prongs 14 towards the arrow release position in response to the output signal. Preferably, release element 45 includes an electric motor, a linear actuator, a hydraulic piston, a pneumatic piston, a solenoid, a spring, a battery, a capacitor, an inductor, a fuel cell, a hydraulic accumulator, a supply of a compressed gas, at least one reactable chemical component and/or at least one combustible material.

In one preferred embodiment of this invention, any suitable combination of sensor 15, sensor position or location with respect to archery bow 110, and transmission means or mechanism can be used to actuate arrow rest 10 to move between the arrow support position and the arrow release position. For example, a sensor 15 including an accelerometer can be positioned within archery arrow shaft 102. Sensor 15 may transmit a signal using radio wave transmission to the activating circuit to move support prongs 14 from the arrow support position to the arrow release position using energy stored in a compressed gas. Alternatively, a sensor 15 including a strain gage can be positioned within a limb pocket of archery bow 110. Sensor 15 may transmit a signal to signal processor 40 using a direct light beam to move support prongs 14 from the arrow support position to the arrow release position using energy supplied by a battery connected to a linear actuator.

In one preferred embodiment of this invention, arrow rest 10 includes an electronic module 16. A suitable battery 17, as is known, is housed or contained within electronic module 16 to power the electronic module components. Preferably, battery 17 includes a shut-off mechanism to conserve battery life when arrow rest 10 is not in use. Electronic module 16 is preferably made of a weather-resistant material and/or sealed to prevent damage to the electrical components of arrow rest 10 due to moisture and other environmental elements.

Figure 7:
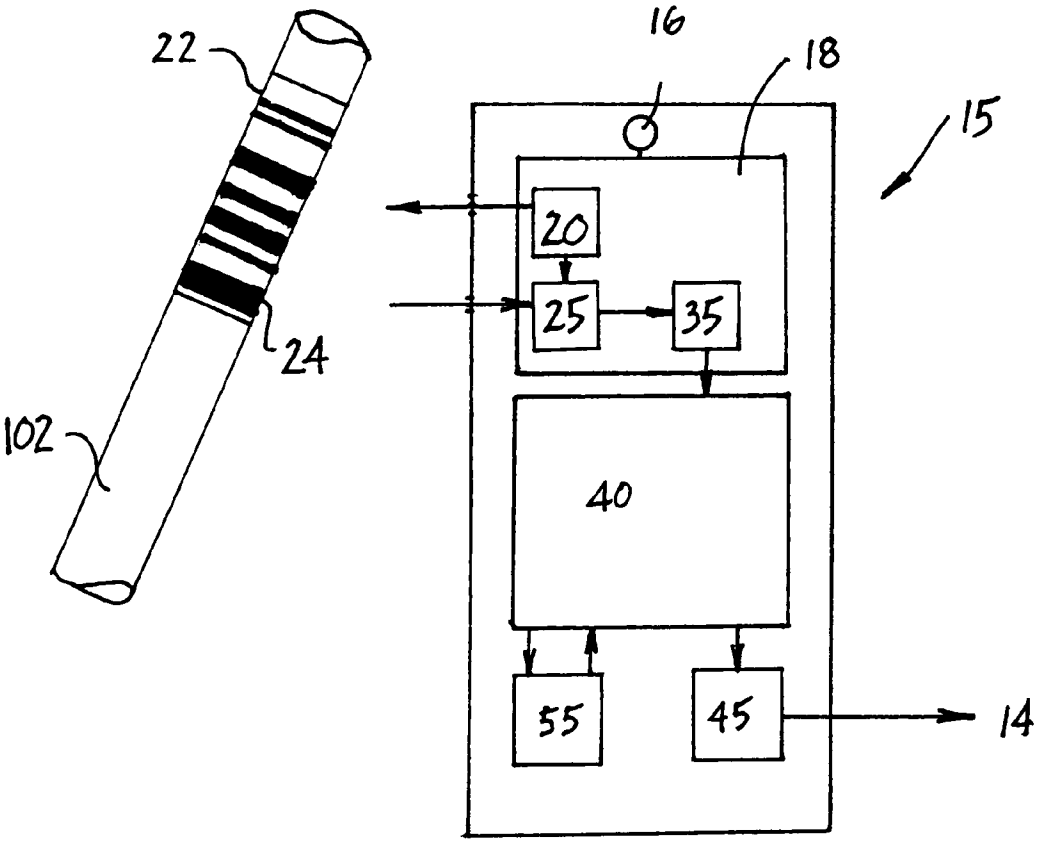
FIG. 7 is a block diagram of an electronic module of an arrow rest schematically showing the electrical components of the arrow rest, according to one preferred embodiment of this invention.
Figure 8:
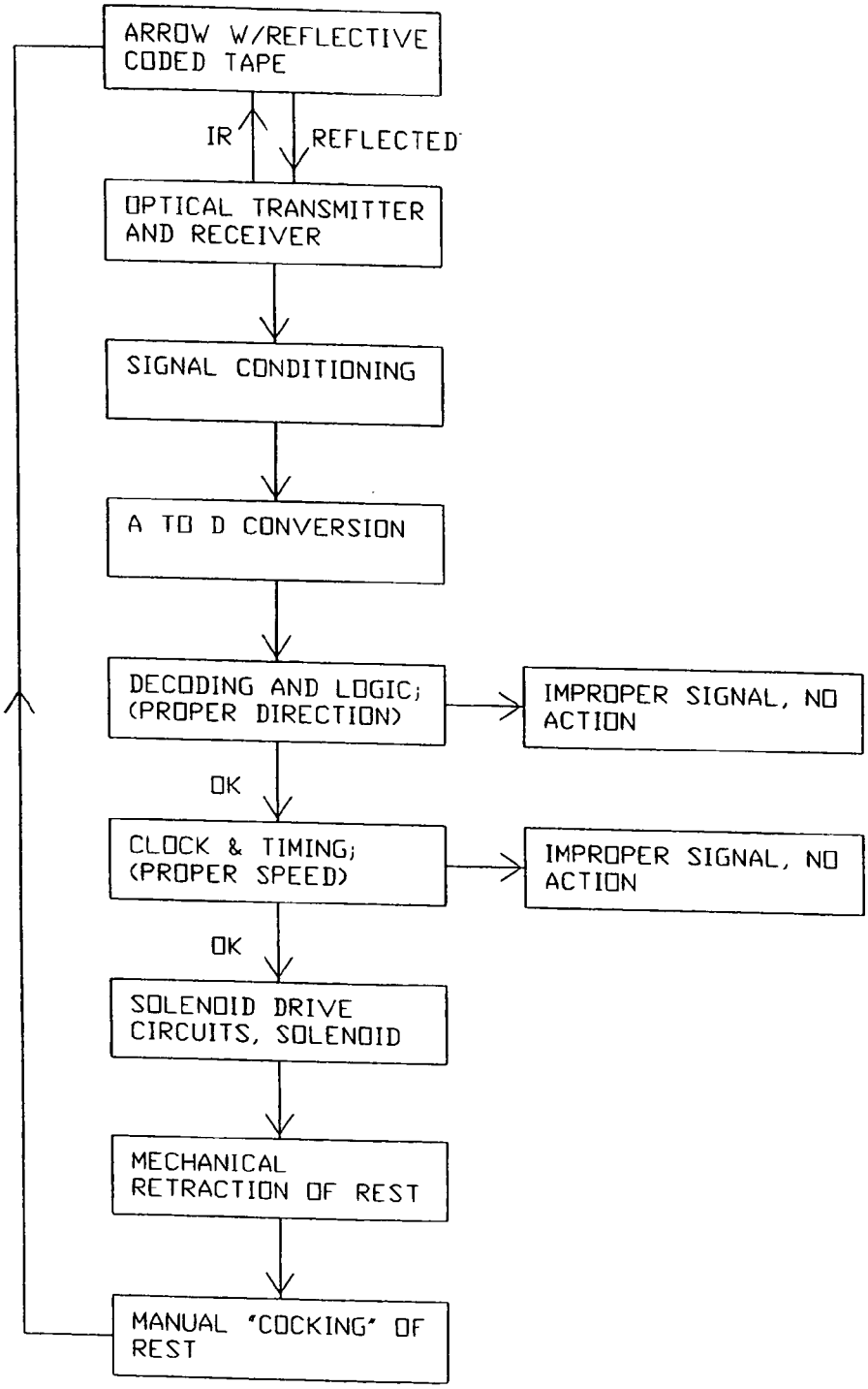
FIG. 8 is a flow chart showing processes involved in the operation of an electrically activated arrow rest, according to one preferred embodiment of this invention.

Referring to FIGS. 6–8, electronic module 16 preferably houses or contains a suitable sensor, such as an optical sensor 18, mountable with respect to a body of the archery bow. As shown schematically in FIG. 7, optical sensor 18 includes an emitter 20 for emitting a light signal at a shaft 102 of archery arrow 100 positioned on arrow rest 10. In one preferred embodiment of this invention, emitter 20 includes a light-emitting diode (LED), such as an infrared light-emitting diode, that emits a light signal at archery arrow shaft 102 positioned on arrow rest 10. Other suitable emitters known in the art can be used to emit the light signal towards shaft 102. As shown in FIG. 6, archery arrow shaft 102 includes a reference mark 22 affixed to shaft 102. Preferably, reference mark 22 is made of a reflective material. For example, reference mark 22 may include a reflective tape material bonded, such as by using an adhesive, about shaft 102 at a determined or set location on shaft 102. Reference mark 22 is preferably positioned on shaft 102 at the determined or set location depending upon the archer's preferred archery bow set-up or configuration. In one preferred embodiment of this invention, reference mark 22 includes a magnetic sensing strip that cooperates with a magnetic release element to actuate release element 45 and move support prongs 14 from the arrow support position to the arrow release position.

In one preferred embodiment of this invention, reference mark 22 includes a bar code 24, as shown in FIGS. 6 and 7. Bar code 22 can include any suitable pattern of markings, circumferential lines or bars and/or any suitable sensible or detectable indicia. Preferably, bar code 22 contains a plurality of asymmetric circumferential bars, as shown in FIGS. 6 and 7. As archery arrow 100 is moved with respect to arrow rest 10 to a drawn or holding position, emitter 20 emits a light signal or another suitable signal at shaft 102. At the holding position, the light signal emitted from emitter 20 against reference mark 22 is reflected by reference mark 22 at electronic module 16. The term holding position as referred to throughout the specification and in the claims is defined as a position of the archery arrow with respect to the archery bow after the archery arrow has been drawn and is temporarily held and supported by the arrow rest in order for the archer to aim the archery arrow at a target, for example.

Optical sensor 18 includes a receiver 25, which senses or detects the reflected light signal. For example, in one preferred embodiment of this invention, receiver 25 detects or senses bar code 24 as the light signal transmitted by emitter 20 is reflected at receiver 25. Therefore, receiver 25 senses reference mark 22 on shaft 102, which indicates that the archery arrow 100 is at the holding position. A transducer 35 in signal communication with receiver 25 transmits a position signal to signal processor 40, in response to receiver 25 detecting or sensing reference mark 22 and indicating that the archery arrow 100 is in the holding position. As shown in FIG. 7, signal processor 40 is in electrical communication with transducer 35 and receives the position signal.

Signal processor 40 receives and processes the transmitted position signal to generate a corresponding electrical output signal, upon determination of a direction of an archery arrow movement and a movement speed. For example, signal processor 40 receives the position signal transmitted by transducer 35 and determines whether the archery arrow is moving in a draw direction with respect to the archery bow or a release direction, which is opposite the draw direction. Additionally, if signal processor 40 determines that the archery arrow is moving in the release direction, a speed of the archery arrow movement is measured or calculated. Based upon the direction and/or speed determinations, signal processor 40 generates and transmits a corresponding or appropriate electrical output signal, which includes either an actuating signal or a stop signal, to release element 45 in communication with signal processor 40. Preferably, but not necessarily, release element 45 is housed or contained within electronic module 16 and operatively connected to support prongs 14.

In one preferred embodiment of this invention, arrow rest 10 includes a timer or a clock 55 in electrical communication with signal processor 40. Timer 55 measures a speed of a movement of the archery arrow with respect to the arrow rest. For example, if signal processor 40 determines that the archery arrow is moving in the release direction, then timer 55 measures or calculates the speed at which the archery arrow is moving in the release direction. A speed at or above a threshold speed represents or indicates that the archery arrow is launched from the archery bow. A speed below the threshold speed conversely represents or indicates that the archery arrow is not launched from the archery bow and is "let down" from the holding position. If the speed of the movement in the release direction is at the threshold speed, then the output signal includes an actuating signal to activate release element 45 and move support prongs 14 from the arrow support position to the arrow release position. Alternatively, if the speed of the movement in the release direction is less than the threshold speed, then the output signal includes a stop signal preventing movement of support prongs 14 from the arrow support position to the arrow release position. Further, if signal processor 40 determines that the archery arrow is moving in the draw direction, then the output signal includes a stop signal preventing movement of support prongs 14 from the arrow support position to the arrow release position. With the stop signal, the drawn archery arrow can be let down or released without activating arrow rest 10 and preferably without undesirable noise, if the archer decides not to launch the archery arrow from the holding position.

Preferably, release element 45 is in responsive communication with the output signal. Release element 45 is actuatable to release support prongs 14 between an arrow support position, as shown in FIG. 6, and an arrow release position, wherein support prongs 14 rotate or pivot in a general release direction through an angle, preferably about 90°. In other preferred embodiments of this invention, support prongs 14 may move between the arrow support position and the arrow release position along a linear path, a rotational path or a combination thereof.

Release element 45 may include any suitable electrical, magnetic and/or mechanical component, such as a magnet, a torsion spring, an extension/compression spring, an air pressure, a gear motor, an electric motor and a solenoid, acting directly or through the use of pulleys, cables, gears and/or rack and pinions, to move support prongs 14. In one preferred embodiment of this invention, release element 45 includes a spring (not shown). The spring has energy by manual activation, for example by cocking or setting arrow rest 10 in the arrow support position. Alternatively, other suitable means for setting arrow rest 10 in the arrow support position may be used, such as a gear motor, which can set arrow rest 10 in the arrow support position after the archery arrow is launched from arrow rest 10, or an electrical setting element having at least one solenoid and/or at least one motor.

Referring to FIG. 8, arrow rest 10 can be electrically activated by emitting a light signal at a shaft of an archery arrow positioned within the arrow rest. The reference mark on the archery arrow shaft is sensed or detected with the archery arrow positioned within the arrow rest at a holding position. The movement of the shaft with respect to the arrow rest is detected and a direction of the movement in either a draw direction or a release direction, which is opposite the draw direction, is determined. Further, the speed of the movement in the release direction is determined and compared to a threshold speed. Based upon the direction of the movement and the speed of the movement, an output signal comprising one of a stop signal and an actuating signal is transmitted to release element 45. With the speed of the movement in the release direction at least equal to a threshold speed, the actuating signal is transmitted to release element 45 to actuate support prongs 14 to move from the arrow support position to the arrow release position.

Thus, this invention provides an arrow rest that is mountable with respect to an archery bow for supporting an archery arrow with respect to the archery bow. The arrow rest includes an emitter, such as a light-emitting diode, that emits a light signal at a shaft of the archery arrow positioned on the arrow rest. An optical sensor is mountable with respect to a body of the archery bow and includes a receiver operatively connected to the emitter. The receiver senses or detects a reference mark positioned on or attached to the shaft, when the archery arrow is at a holding position. A transducer generates and transmits a position signal in response to the optical sensor sensing or detecting the reference mark to a signal processor in electrical communication with the optical sensor. The signal processor receives the position signal transmitted by the transducer, and generates an output signal in response to the position signal based on a direction of a movement of the archery arrow with respect to the archery bow and a speed of the movement.

The arrow rest includes support prongs for supporting the archery arrow shaft. The support prongs are in responsive communication with the output signal, and are movable in response to the output signal between an arrow support position and an arrow release position. A release element is in responsive communication with the signal processor and operatively connected to the support prongs. The release element may include a spring, a gear motor, an electric motor and/or a solenoid, and is actuatable to release the support prongs towards the arrow release position, in response to the output signal.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. An arrow rest mountable to an archery bow for supporting an archery arrow with respect to the archery bow, the arrow rest comprising:

an optical sensor mountable with respect to a body of the archery bow, an emitter of the optical sensor emitting a light signal at a shaft of the archery arrow positioned on the arrow rest, the optical sensor having a receiver for sensing a reference mark on the shaft with the archery arrow at a holding position, a transducer transmitting a position signal in response to the optical sensor sensing the reference mark;

a signal processor in electrical communication with the optical sensor and receiving the position signal transmitted by the transducer, the signal processor generating an output signal in response to the position signal; and a release element in responsive communication with the output signal, the release element actuatable in response to the output signal to move at least one support prong of the arrow rest between an arrow support position and an arrow release position, the reference mark comprising a bar code, the bar code being asymmetric, the receiver sensing the bar code and the transducer transmitting the position signal to the signal processor, and the signal processor determining whether the archery arrow moves in a draw direction with respect to the archery bow or a release direction which is opposite the draw direction, and generating the output signal.

2. The arrow rest of claim 1 wherein an infrared light-emitting diode emits the light signal.

3. The arrow rest of claim 1 wherein the reference mark is of a reflective material.

4. The arrow rest of claim 1 further comprising a timer measuring a speed of the archery arrow moving with respect to the arrow rest in the release direction.

5. The arrow rest of claim 4 wherein, with the archery arrow moving in the release direction at a threshold speed, the output signal comprises an actuating signal component that activates the release element and moves the at least one support prong from the arrow support position to the arrow release position.

6. The arrow rest of claim 4 wherein, with the archery arrow moving in the release direction at less than a threshold speed, the output signal comprises a stop signal component to prevent movement of the at least one support prong from the arrow support position to the arrow release position.

7. The arrow rest of claim 1 wherein, with the archery arrow moving in the draw direction, the output signal comprises a stop signal component that prevents movement of the at least one support prong from the arrow support position to the arrow release position.

8. The arrow rest of claim 1 wherein the output signal comprises one of an actuating signal component and a stop signal component.

9. The arrow rest of claim 1 wherein the reference mark is of a magnetic material.

10. An arrow rest mountable to an archery bow for supporting an archery arrow with respect to the archery bow, the arrow rest comprising:

an electronic module having an emitter emitting a light signal at a shaft of the archery arrow positioned on the arrow rest and having a receiver for sensing a reference mark on the shaft at a holding position, a transducer transmitting a position signal in response to the receiver sensing the reference mark, the electronic module having a signal processor in electrical communication with the transducer for receiving the position signal and generating an output signal upon determination of a direction of an archery arrow movement and a movement speed; and a release element in responsive communication with the output signal, the release element actuatable to release at least one support prong of the arrow rest from an arrow support position to an arrow release position in response to the output signal, the reference mark comprising a bar code, the bar code being asymmetric, and the signal processor determining whether the archery arrow is moving in a draw direction with respect to the archery bow or a release direction which is opposite the draw direction.

11. The arrow rest of claim 10 wherein a light-emitting diode emits the light signal.

12. The arrow rest of claim 10 wherein the reference mark is of a reflective material.

13. The arrow rest of claim 10 further comprising a timer measuring a speed of the archery arrow moving in the release direction.

14. The arrow rest of claim 13 wherein, with the archery arrow moving in the release direction at a threshold speed, the output signal comprises an actuating signal component that actuates the release element.

15. The arrow rest of claim 13 wherein, with the archery arrow moving in the release direction at a speed less than a threshold speed, the output signal comprises a stop signal component that prevents movement of the at least one support prong from the arrow support position to the arrow release position.

16. The arrow rest of claim 10 wherein, with the archery arrow moving in the draw direction, the output signal comprises a stop signal component that prevents movement of the release element from the arrow support position to the arrow release position.

17. The arrow rest of claim 10 wherein the reference mark is of a magnetic material.

18. An arrow rest mountable with respect to an archery bow for supporting an archery arrow with respect to the archery bow, the arrow rest comprising:

a light-emitting diode emitting a light signal at a shaft of the archery arrow positioned on the arrow rest;

an optical sensor mountable with respect to a body of the archery bow and operatively connected to the light-emitting diode, the optical sensor having a receiver for sensing a reference mark on the shaft with the archery arrow at a holding position, a transducer transmitting a position signal in response to the optical sensor sensing the reference mark;

a signal processor in electrical communication with the optical sensor and receiving the position signal transmitted by the transducer, the signal processor generating an output signal in response to the position signal based on a direction of a movement of the archery arrow with respect to the archery bow and a speed of the movement; and at least one support prong of the arrow rest in responsive communication with the output signal, in response to the output signal the at least one support prong movable between an arrow support position and an arrow release position.

19. The arrow rest of claim 18 further comprising a release element in responsive communication with the signal processor and operatively connected to the at least one support prong, the release element actuatable to release the at least one support prong towards the arrow release position in response to the output signal.

20. The arrow rest of claim 18 wherein the release element comprises at least one of a spring, a gear motor, an electric motor and a solenoid.

21. A method for actuating an arrow rest comprising:

emitting a light signal at a shaft of an archery arrow positioned within the arrow rest;

sensing a reference mark on the shaft with the archery arrow positioned within the arrow rest at a holding position;

detecting a movement of the shaft with respect to the arrow rest;

determining a direction of the movement in one of a draw direction and a release direction which is opposite the draw direction;

determining a speed of the movement in the release direction;

transmitting one of a stop signal and an actuating signal based on the direction of the movement and the speed of the movement; and actuating at least one support prong of the arrow rest to move from an arrow support position to an arrow release position with the speed of the movement in the release direction at least equal to a threshold speed.

* * * * *